United States Patent [19]

Vogt et al.

[11] Patent Number: 4,463,697

[45] Date of Patent: Aug. 7, 1984

[54] METHOD AND DEVICE FOR PRODUCING A POCKET ON A WORKPIECE

[75] Inventors: Siegfried Vogt; Günter Hagemeyer, both of Leopoldshöhe; Friedrich Klöpperpieper, Bielefeld, all of Fed. Rep. of Germany

[73] Assignee: Kochs Adler AG, Bielefeld, Fed. Rep. of Germany

[21] Appl. No.: 411,237

[22] Filed: Aug. 25, 1982

[30] Foreign Application Priority Data

Oct. 2, 1981 [DE] Fed. Rep. of Germany ..... 3139223

[51] Int. Cl.[3] ..... D05B 97/00; D05B 35/00; D05B 21/00

[52] U.S. Cl. ..... 112/262.3; 112/121.15; 112/147

[58] Field of Search ..... 112/262.3, 262.1, 121.15, 112/121.12, 121.11, 141, 147

[56] References Cited

U.S. PATENT DOCUMENTS 3,483,834 12/1969 Bennison ..... 112/121.15
3,528,378 9/1970 Westhoff et al. ..... 112/121.15
3,552,336 1/1971 Brandriff et al. ..... 112/121.15
4,068,603 1/1978 Arbter ..... 112/147

*Primary Examiner*—H. Hampton Hunter
*Attorney, Agent, or Firm*—Max Fogiel

[57] ABSTRACT

A method and a device for producing a pocket on a workpiece in which a pocket cut is folded at a margin of two lateral portions and one bottom portion connecting the lateral portions and attached by a stitch row to a workpiece. According to the invention, the folded pocket cut is additionally formed with folds situated in the lateral portions so as to manufacture extensible and spacious bellow-typed pockets. The device for producing such extensible pockets on workpieces is equipped with a workpiece folding device for folding the pocket according to the method described, a sewing machine and a control system for controlling a relative motion between the needle of the sewing machine and the workpiece and the folded pocket cut, so as to automatically perform a fastening stitch row according to a predetermined contour for attaching the folded pocket cut onto the workpiece.

11 Claims, 11 Drawing Figures

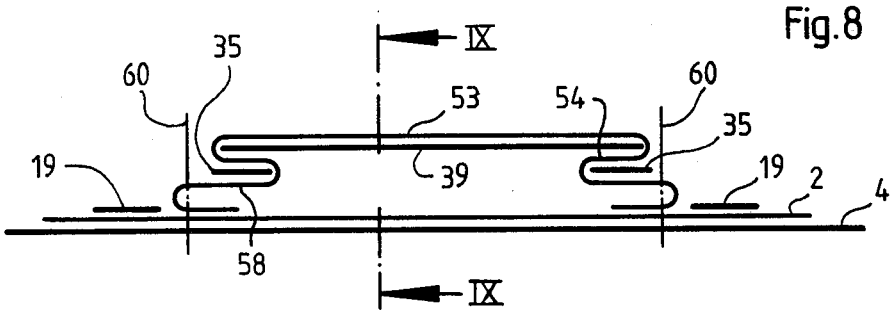
Fig. 8
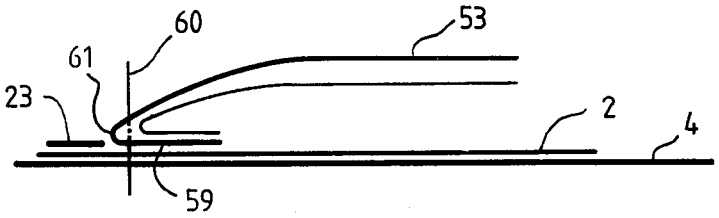
Fig. 9
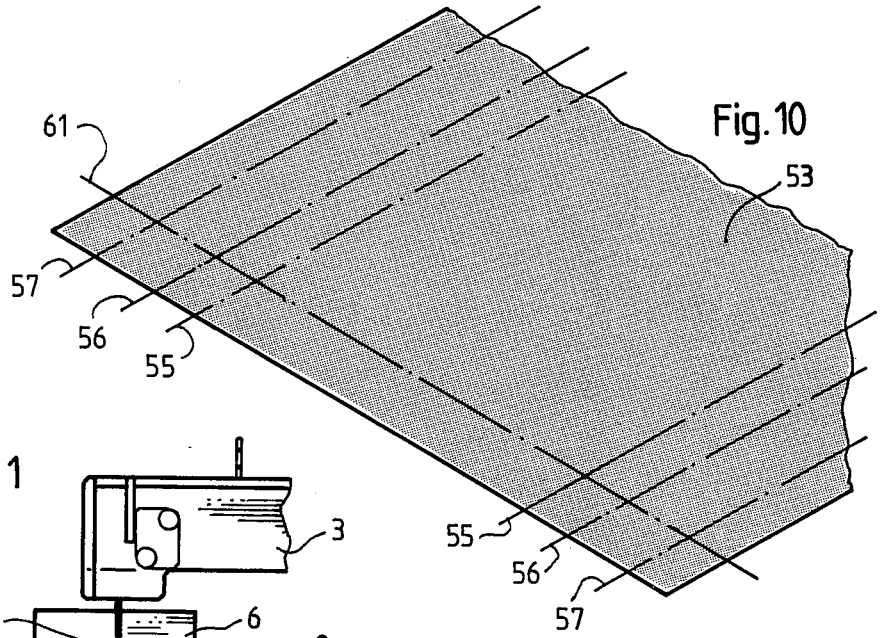
Fig. 10
Fig. 1
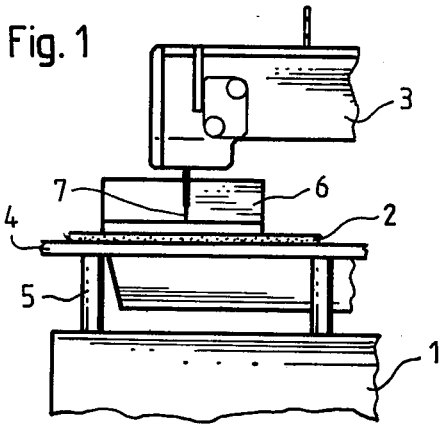

METHOD AND DEVICE FOR PRODUCING A POCKET ON A WORKPIECE

BACKGROUND OF THE INVENTION

The present invention relates in general to a method and a device for producing a pocket, where a pocket cut is folded at a margin of two lateral portions and one bottom portion connecting the lateral portions and attached by a stitch row to a workpiece.

From the German laid-open patent application DE-OS 20 25 312 or the related U.S. Pat. No. 3,552,336 a method and an apparatus of such kind are known, in which the pocket cut is clamped on a folding sword and folded about two lateral edges of leg portions by lateral slides, and, if desired, by a front slide at a bottom edge connecting the two leg portions. The folded workpiece cut is firmly clamped at the folded edges during a sewing procedure. In order not to impede the sewing of the folded workpiece cut onto the garment, the folding sword consists of a plurality of parts withdrawn out of the area where the stitching is carried out.

A device and a method of such kind is, in principle, also known from the German laid-open patent application DE-OS No. 16 60 924.

In all known applications it is not possible to provide a pocket cut having marginal folds additionally with lateral folds so as to manufacture extensible and spacious bellow-typed pockets.

The procedure for manufacturing such pockets provided additionally with lateral folds can be described as follows: At first the pocket cuts are creased or folded at the edges and pressed by separate devices as pressers and creasers. After this operation the pre-pressed folded pocket cuts are manually sewn onto garments. As obvious, the operation of stitching a pocket cut onto the garment is quite difficult and time-consuming and requires a highly skilled operator.

SUMMARY OF THE INVENTION

It is a main object of the present invention to provide a method and apparatus of the afore-described type and to additionally provide the pocket cut folded about marginal portions with lateral folds.

It is a further object of this invention to provide a method and apparatus which make possible pocket manufacturing, in which the marginal folds and additional lateral folds are formed in a fully automated operation for producing pockets of the aforesaid design of high and stable quality.

Another important object of the present invention is to reduce the cost of producing pockets according to the design described, in which separate devices or auxiliary equipment are eliminated.

Still another object of the present invention is to provide a method and apparatus for increasing production, while reducing the skill of the operator.

It is a further object of the present invention to provide apparatus for the production of the afore-described pockets, in which additionally formed lateral folds are firmly secured in their positions during the sewing process.

Other objects and advantages of the invention will become apparent from the following description and the novel features will be particularly pointed out in the claims.

BRIEF DESCRIPTION OF THE DRAWINGS

FIG. 1 is a partial front view of an automatic sewing arrangement;

FIGS. 3 to 8 are schematic representations of pocket folding operations illustrated according to line III—III in FIG. 2;

FIG. 9 is a sectional view of the schematically-represented folded pocket taken along line IX—IX of FIG. 8;

FIG. 10 shows a pocket cut in an unfolded condition; and

DESCRIPTION OF THE PREFERRED EMBODIMENTS

Figure 2:
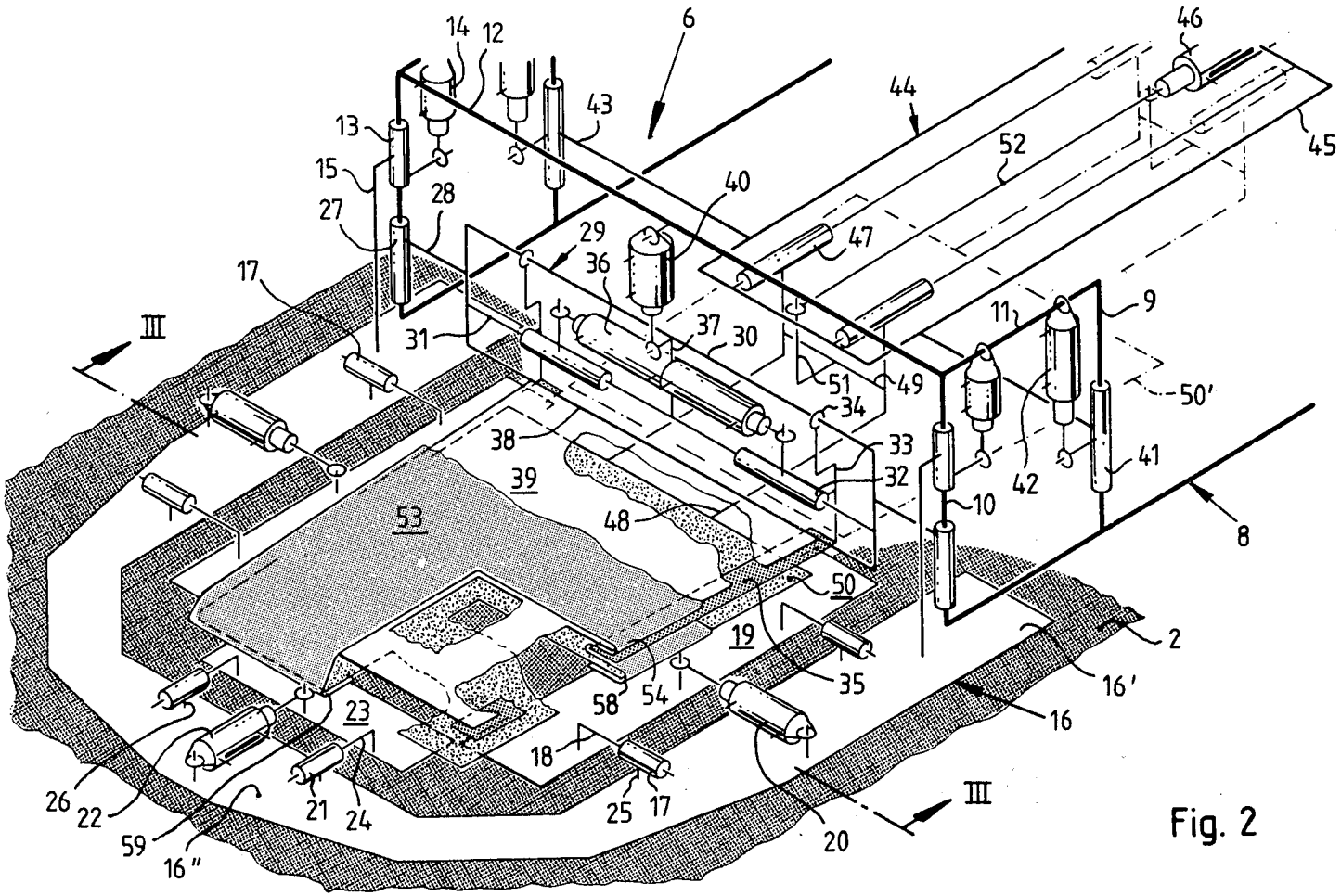
FIG. 2 is a perspective representation of a workpiece clamp of the automatic sewing arrangement.

FIG. 1 refers to an automatic sewing arrangement having a stand 1 for receiving a feeding device (not shown) for a workpiece 2 and a sewing head 3. The sewing head 3 is mounted on a workpiece supporting plate 4, which is supported with respect to the stand 1 by posts 5. The aforementioned feeding device may be constructed as illustrated and described in the German laid-open patent application DE-OS No. 30 00 831 or DE-OS No. 31 36 953. This feeding device carries a workpiece clamp 6, which is displaceable only in two horizontal coordinates with respect to the needle 7 of the sewing head 3. The needle 7 oscillates vertically on a stationary path, so that there may be produced a seam of a pre-determined contour on the workpiece 2 displaceable on the workpiece supporting plate 4 by means of the workpiece clamp 6.

According to FIG. 2 the workpiece clamp 6 is symmetrically structured with respect to a vertical center plane (not shown) extending in FIG. 2 from the bottom of the left to the top of the right. For this reason, all double shown parts are denoted by only one reference number.

The workpiece clamp 6 is provided with a supporting frame 8 having vertical guide rods 9, 10 extending parallel to each other. The guide rods 9, 10 arranged at each side are each connected by a horizontally extending connecting rod 11 arranged also in parallel to each other. Each set of guide rods 9, 10 and the connecting rod 11 is fixedly connected to the opposite set by means of a crossbar 12. On each front guide rod 10 there is displaceably arranged a slide bearing 13, which is connected to a drive cylinder 14, the free end of which is secured to the guide rod 11. The slide bearing 13 is rigidly connected to a U-shaped clamping frame 16 by means of a connecting bar 15, so that the clamping frame 16 is liftable or lowerable in a vertical plane by the correspondingly actuated drive cylinder 14.

At least two horizontal slide bearings 17 are mounted to each shank 16' of the clamping frame 16. The slide bearings 17 are horizontally and parallelly aligned to each other for receiving guide rods 18, to the free inwardly extending ends of which are secured lateral slides 19. To each lateral slide 19 there is further hinged a drive cylinder 20, the free end of which is also secured to the correspondent shank 16' of the clamping frame 16. The direction of displacement of the drive cylinder 20 is in parallel with the extension of the guide rods 18, so that the two lateral slides 19 may be displaced parallel to each other off the shanks 16', i.e. inwardly or towards the shanks 16', i.e. outwardly. Similarly, to the crossbar 16" of the clamping frame 16 there are mounted two slide bearings 21 and a drive cylinder 22, which are connected to a front slide 23. The slide bearings 21 are provided with guide rods 24 for receiving the front slide 23, so that the front slide 23 is displaceable by means of the correspondingly actuated drive cylinder 22 in the plane of the lateral slides 19 but vertically with respect to the direction of displacement of the latter, i.e. in the longitudinal direction of the workpiece clamp 6.

The slide bearings 17 are connected to the shanks 16' by means of connecting pieces 25, as the slide bearings 21 are connected to the crossbar 16" by means of connecting pieces 26.

Below the slide bearings 13 there is vertical and displaceably arranged to each front guide rod 10, a further slide bearing 27, to which is transversely secured a supporting frame 29 by means of connecting pieces 28. This supporting frame 29 is provided with two parallel to each other and in a common vertical plane horizontally extending—i.e. one above the other arranged—guide rods 30, 31. To the lower guide rod 31 there are arranged two slide bearings 32, to each of which is connected a connecting rod 33. The connecting rods 33 are displaceably supported on the upper guide rod 30 in the longitudinal direction of the latter by a guide bearing 34. To the lower end of the connecting rod 33 there is mounted the rear end of a folder 35 formed by a rectangular small and thin plate. The folders 35 are displaceable parallel with respect to the clamping frame 16 or to the lateral slides 19 and the front slide 23 by means of a pair of back-to-back mounted drive cylinders 36 which are fastened at their common back to a connecting piece 37 of the supporting frame 29 and on their free ends to the slide bearings 32. Furthermore, to a lower connecting rod 38 of the supporting frame 29 there is fastened a clamping plate 39 which also extends parallel, i.e. horizontally with respect to the clamping frame 16. Centrally to the upper crossbar 12 there is secured a drive cylinder 40, the lower end of which is hinged to the upper guide rod 30 of the supporting frame 29. When the drive cylinder 40 is actuated correspondingly, the supporting frame 29 and thus, on one hand, the clamping plate 39, and the folders 35, on the other hand, are vertically moved up or down.

Moreover, to each rear vertical guide rod 9 there is arranged a slide bearing 41 which is vertically displaceable by means of a drive cylinder 42 hinged to the upper connecting rod 11. The two slide bearings 41 are connected by a transversely extending connecting rod 43 to which is secured a horizontal bearing frame 44. Two horizontal and parallel to each other in longitudinal direction extending guide rods 45 and a centrally arranged drive cylinder 46 are mounted to the bearing frame 44. On the guide rods 45 there are located slide bearings 47 each provided with an angularly formed supporting arm 48 extending to the front. The supporting arms 48 are connected together by means of a connecting piece 49. To the front end of the supporting arms 48 there is mounted a folding sword 50 extending horizontally and parallel with respect to the clamping frame 16. To the connecting piece 49 there is secured an upwardly extending bracket 51 to which is hinged a piston rod 52 of the drive cylinder 46. The stroke of the cylinder 46 is defined so as to draw the folding sword 50 completely out of the clamping frame 16 into the dot-dash-lined position 50'.

The shape of the folding sword 50 corresponds with that of a pocket to be folded. The shape of the clamping plate 39 is formed similarly but smaller, i.e. its peripheral edges are retracted inwards from those of the folding sword 50.

All of the aforementioned drive cylinders may economically be structured as cylinders operated by air pressure.

Figure 3:
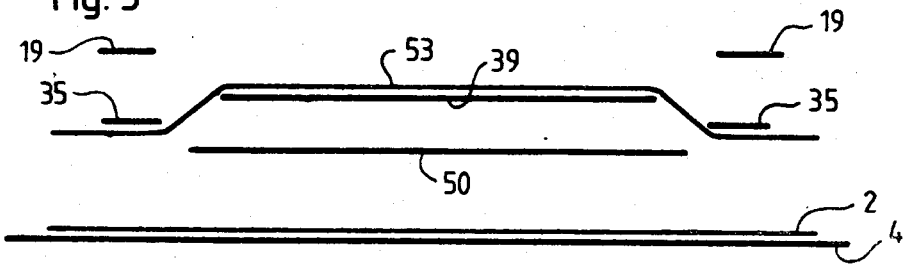
Figure 4:
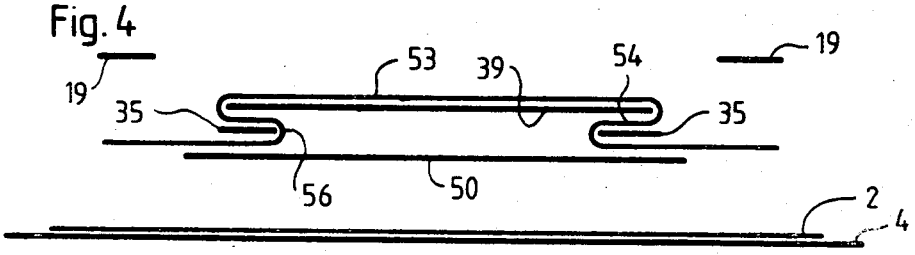

The operation of the described workpiece clamp 6 in conjunction with a pocket folding device may be explained with the aid of FIGS. 3 to 9 of the drawings as follows:

In the initial position of the workpiece clamp 6 shown in FIG. 3, the lateral slides 19 together with the clamping frame 16 (omitted in FIG. 3) are positioned in a lifted position by the action of the drive cylinder 14. Furthermore, the lateral slides 19 are moved outwards towards the shanks 16' of the clamping frame 16 by the correspondingly actuated drive cylinder 20. The same applies to the front slide 23. Also the clamping plate 39 together with the folders 35 are brought into their upper position by the acting drive cylinder 40 engaging the supporting frame 29. The folders 35 are moved into their outward positions by the correspondingly actuated drive cylinders 36. Moreover, the folding sword 50 is located in its upper position by the correspondingly actuated drive cylinder 42. Consequently, the workpiece supporting plate 4 is free for receiving the workpiece 2. After that, a pocket cut 53 is put upon the clamping plate 39, at which the edges of the pocket cut 53 are positioned below the folders 35. Subsequently, the drive cylinders 36 are actuated so as to move the folders 35 inwards and below the correspondent edge of the clamping plate 39, remaining, however, above the folding sword 50. By this, as evident from FIG. 4, a first fold 54 is formed at both longitudinal sides of the pocket cut 53. These first folds 54 are produced by folding the pocket cut 53 along the inner folding lines 55, 56 as illustrated in FIG. 10.

Figure 5:
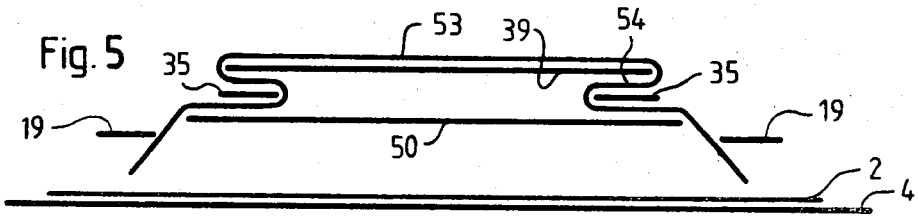
Figure 6:
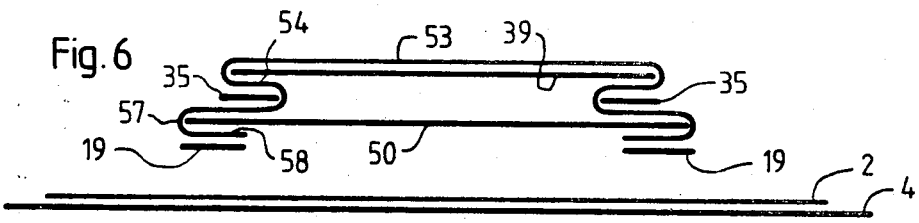

Subsequently, as evident from FIG. 5, the lateral slides 19 and the front slide 23 are brought into a position directly below the folding sword 50 by lowering the clamping frame 16 by means of the drive cylinders 14. When actuating the drive cylinder 20, the lateral slides 19 are moved inwards, at which the edges of the pocket cut 53 are folded inwards about the outer folding lines 57 as illustrated in FIG. 10 so as to form a second fold 58.

Subsequently, the front slide 23 is operated by the actuation of the drive cylinder 22 so as to fold a single fold 59 only (see FIG. 9) by infolding the lower margin of the pocket cut 53 about a folding line 61, thus giving the pocket 53 its finally folded condition.

Figure 7:
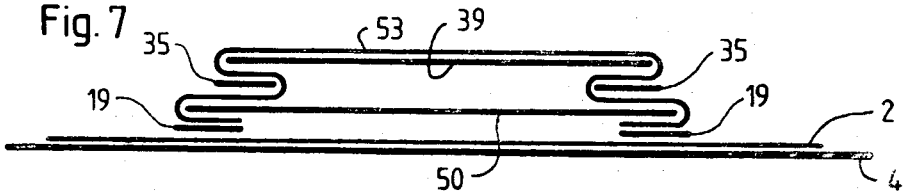

In this clamped condition, the folded pocket cut 53 is lowered upon the workpiece 2 by simultaneously actuating the drive cylinders 14, 40, 42 as illustrated in FIG. 7. As soon as the folded pocket cut 53 is pressed against the workpiece 2, the folding sword 50 is drawn into the retracted position 50' by the actuation of the drive cylinder 46. Subsequently, by the actuation of the drive cylinders 20 and 22, the lateral slides 19 and the front slide 23 are drawn into their initial positions adjacent to the shanks 16' and to the crossbar 16", respectively. In this condition of the workpiece clamp 6 as shown in FIG. 8, the needle 7 may perform a fastening seam 60 so as to connect the folds 58 and 59 with the workpiece 2 as the folds 54 are positioned so as not to interfere with the working needle 7.

As evident from FIG. 8, while sewing, the folders 35 remain in the lateral first folds 54 of the pocket cut 53 which is pressed from inside onto the workpiece 2 by means of the clamping plate 39. Consequently, while sewing, the first folds 54 are fixed in position by the clamping plate 39 in connection with the folders 35. Due to the friction existing between the pocket cut material in the area of the second folds 58 and the lower fold 59, and the workpiece material, not only the pocket cut 53 but also the workpiece 2 is slidingly moved by a feeding device (not illustrated) in the plane of the workpiece supporting plate 4. Thus, the folded pocket cut 53 and the workpiece 2 are fed with respect to the needle 7 according to the contour of the fastening seam 60.

After termination of the sewing operation, the pressure of the clamping plate 39 is released by depressurizing the drive cylinder 40, so that the folders 35 may be drawn out outwardly. After lifting the clamping frame 16 into the position as illustrated in FIG. 3 by actuation of the drive cylinder 14, the workpiece 2 together with the folded and attached pocket cut 53 may be removed from the clamping plate 39.

Figure 11:
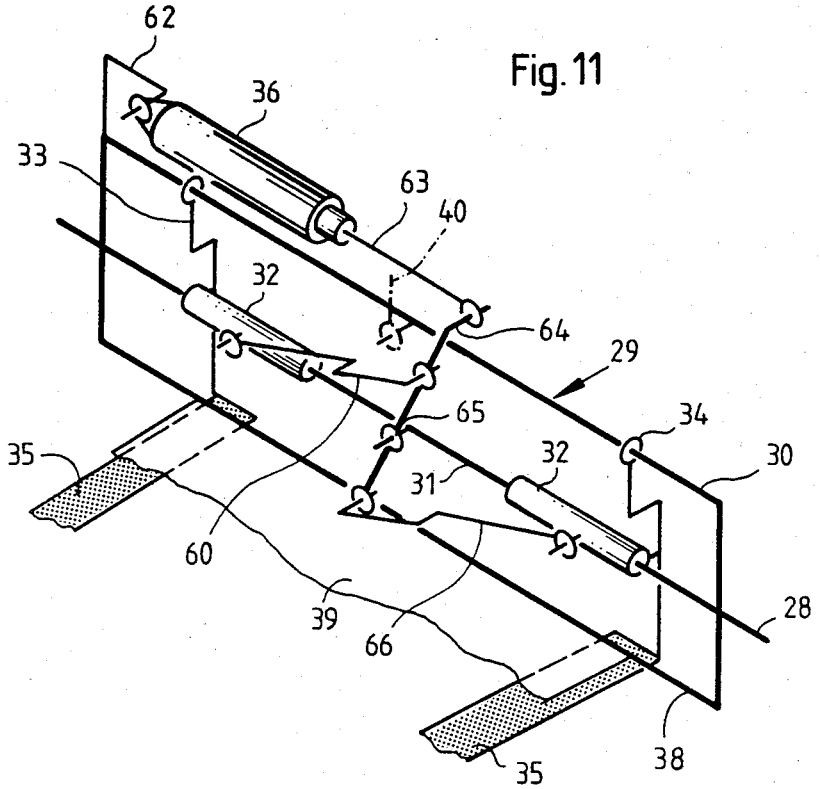
FIG. 11 shows a constructional detail of FIG. 2 in a modified manner.

The embodiment according to FIG. 11 differs from that of FIG. 2, as the slide bearings 32 for laterally displacing the folders 35 are operable by a single drive cylinder 36'. The cylinder 36' is hinged to a bracket 62 arranged at the supporting frame 29. The piston rod 63 of the drive cylinder 36' is secured to the outer end of a double armed lever 64 pivotally fastened by means of a swivel bearing 65 to the lower guide rod 31 of the supporting frame 29 carrying the slide bearings 32. Evenly spaced from the swivel bearing 65, there are hinged tie rods 66 to the lever 64. The free ends of the tie rods 66 are each hinged to one of the two slide bearings 32. As the drive cylinder 36' is actuated, this kinematic connection of the folders 35 by means of the double armed lever 64 effects a simultaneous and equal displacement of the folders 35. Due to this drive an undesired lateral displacement of the pocket cut 53 with respect to the workpiece 2 is positively eliminated as the folding takes place.

Without further analysis, the foregoing will so fully reveal the gist of the present invention that others can, by applying current knowledge, readily adapt it for various applications with out omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A method for producing a pocket comprising the steps of:

a folding step for folding a pocket cut at marginal edges having two lateral portions and a bottom portion connecting said laterial portions; and a sewing step for attaching said folded pocket cut at said folded marginal edges to a workpiece by a stitch row, said folded pocket cut being clamped on said workpiece;

said folding step including:

a first folding step for producing a first fold at at least one of said lateral portions, and a second folding step for producing the folding of said marginal edges, said first fold being rebounded with respect to said folded marginal edges.

2. A method according to claim 1, at least one pair of folds at said lateral portions are produced in said first folding step.

3. A method according to claim 2, wherein said folded pocket cut is clamped onto the workpiece during the sewing step by pressing the first folds onto the folded marginal edges of said pocket cut.

4. A method according to claim 3, wherein the pair of folds is bi-directionally clamped in position as said sewing step is performed.

5. A method for producing a pocket comprising the steps of:

a folding step for folding a pocket cut at marginal edges having two lateral portions and a bottom portion forming substantially a U-shaped configuration; and a sewing step for attaching said folded pocket cut at said folded marginal edges to a workpiece by a stitch row, said folded pocket cut being clamped at said folded marginal edges onto said workpiece;

said folding step including:

a first folding step for producing at least one pair of folds in said lateral portions, and a second folding step for producing the folding of said marginal edges, said pair of folds being rebounded with respect to said folded marginal edges and being bi-directionally positioned and clamped in position during the sewing step, said folded pocket cut being clamped onto said workpiece during said sewing step by pressing the first folds onto the folded marginal edges of said pocket cut.

6. Apparatus for producing a pocket comprising:

a sewing machine including stitch forming means with a needle;

control means for producing said stitch row according to a predetermined contour as a relative movement between said needle and said workpiece including said pocket cut; and means for receiving said workpieces comprising:

sword means defining said geometrical configuration of said folded pocket cut;

means for retracting said sword means out of the sewing region;

creasing means operating upon the marginal edges of said unfolded pocket cut having:

two side creasers acting upon said two lateral portions, and a front creaser acting upon said bottom portion, and clamping means arranged above said sword means and having a similar and smaller geometrical configuration as said sword means for clamping said folded pocket cut, said clamping means comprising: outside edges and folder blades movably arranged below said clamping means and cooperating with said outside edges so as to form a fold at each of said lateral portions prior to the marginal edge folding of said pocket cut.

7. Apparatus according to claim 6, wherein said clamping means further comprises: a bracket receiving said folder blades and a clamping plate.

8. Apparatus according to claim 7, and said bracket further having bearing means for slidably receiving said folder blades and at least one piston-cylinder drive for displaceably operating said folder blades.

9. Apparatus for producing a pocket comprising:

a sewing machine including a supporting plate and stitch forming means with a needle;

control means for producing said stitch row according to a predetermined contour as a relative movement between said needle and said workpiece including said pocket cut supported by said supporting plate; and means for receiving said workpieces, comprising:

a frame movably arranged with respect to said needle and in a firm parallel plane relative to said supporting plate;

a clamp for clamping said workpiece on said supporting plate, said clamp being raiseably or lowerably pivoted at said frame;

a first bracket lowerably pivoted at said frame;

a first plate retractably pivoted at said first bracket and having fold edges;

lateral slides slidably received on said clamp and cooperating with said fold edges of said plate so as to fold the marginal edges of said pocket cut;

a second bracket lowerably pivoted at said frame;

a second plate having a similar and reduced geometric configuration than the first plate, including lateral edges, said second plate being fastened to said second bracket;

bearing means extending parallelly to said supporting plate and situated at said second bracket;

folders each fastened to said bearing means cooperating with said lateral edges of said second plate for forming said pair of folds in said lateral portions; and drive means arranged on said second bracket for laterally moving said folders.

10. Apparatus according to claim 9, wherein said drive means comprises separate cylinders driving said folders.

11. Apparatus according to claim 10, wherein said drive means comprises:

a cylinder arranged at said second bracket and a linkage system drivingly connected to said cylinder and said folders so as to provide a simultaneous folding action of said folders.

* * * * *